United States Patent [19]

Luff

[11] 4,020,990

[45] May 3, 1977

[54] SPRAY GUN

[75] Inventor: Stanley Herbert Luff, Hull, England

[73] Assignee: Humbrol Limited, Hull, England

[22] Filed: Jan. 19, 1976

[21] Appl. No.: 649,934

[30] Foreign Application Priority Data

May 6, 1975 United Kingdom ..... 18861/75

[52] U.S. Cl. ..... 239/346; 239/530; 251/111

[51] Int. Cl.[2] ..... B05B 7/08

[58] Field of Search ..... 239/346, 318, 525, 530; 251/229, 111, 242, 244, 321

[56] References Cited

UNITED STATES PATENTS

| | | | |
|---|---|---|---|
| 1,099,767 | 6/1914 | Read | 239/309 X |
| 2,595,826 | 5/1952 | Winks et al. | 239/346 X |
| 2,815,984 | 12/1957 | Llopis | 239/346 X |
| 3,295,820 | 1/1967 | Zipper | 251/229 |
| 3,780,950 | 12/1973 | Brennan | 222/215 X |

*Primary Examiner*—Johnny D. Cherry
*Assistant Examiner*—Michael Mar
*Attorney, Agent, or Firm*—Fred Philpitt

[57] ABSTRACT

A spray gun or air brush comprising a spray head which carries a liquid spray nozzle or jet fed by a tube depending therefrom into a liquid reservoir, an air jet positioned adjacent the spray nozzle and mechanism for conducting pressure air from a source to the air jet to cause a stream of air past the spray jet whereby a negative pressure induced in the latter draws liquid from the reservoir and into the air stream wherein it is entrained as minute droplets. A manually operable air valve, having a valve seat and a valve closure member movable towards and away from the seat, is situated in the air flow path to admit air to or to prevent it from reaching the air jet and a manually adjustable mechanism is provided to limit opening movement of the valve closure member so as to control the size of the air flow region between the valve closure member and the seat.

7 Claims, 5 Drawing Figures

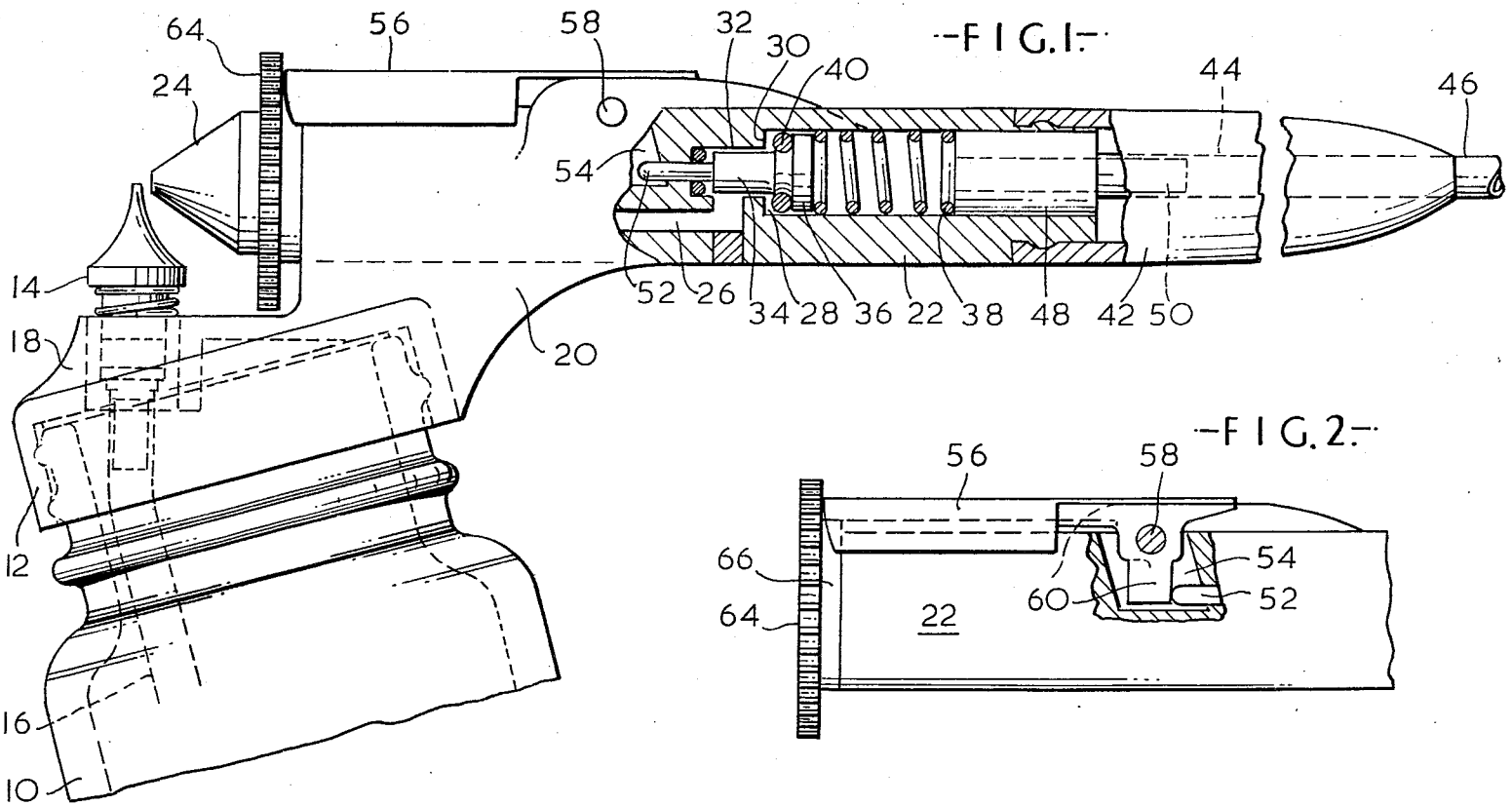
-FIG. 1.-
-FIG. 2.-

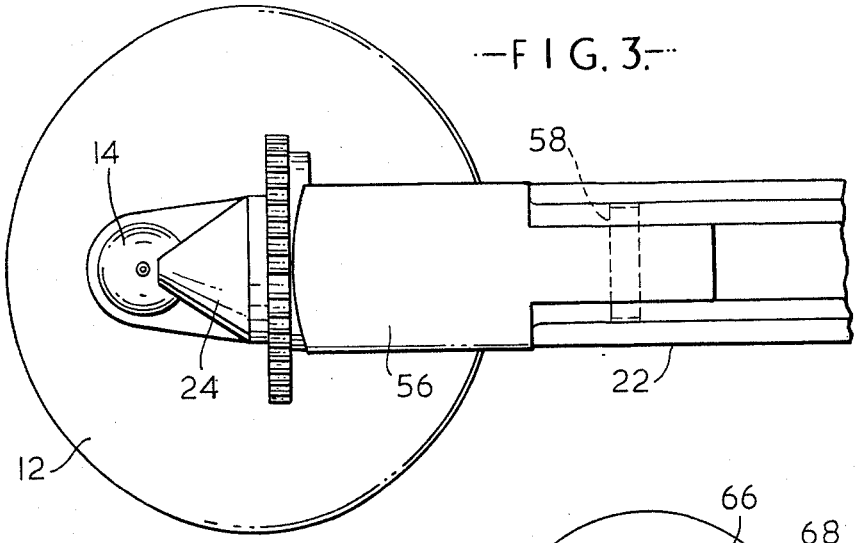
-FIG. 3-
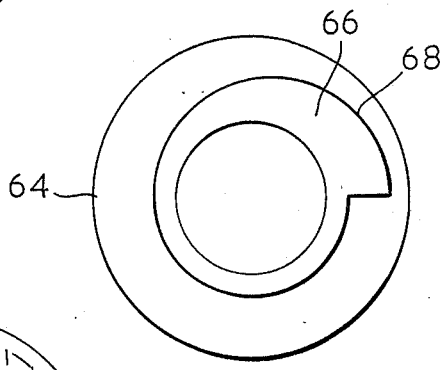
-FIG. 5-
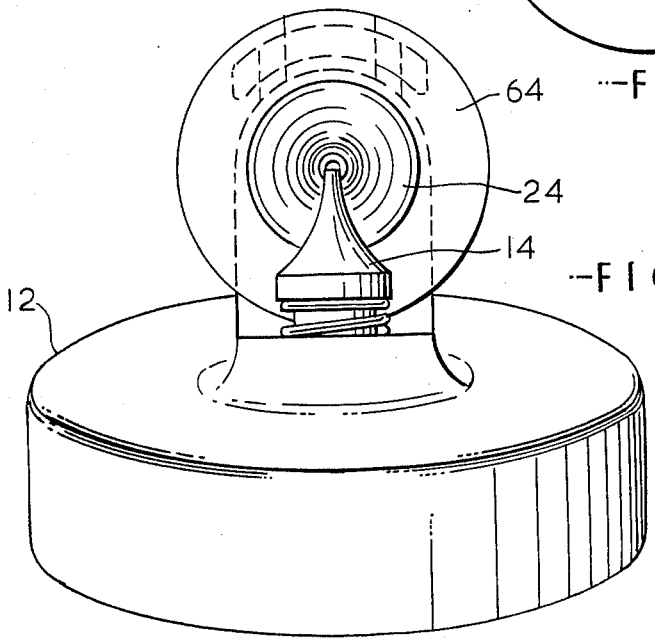
-FIG. 4-

SPRAY GUN

This invention concerns apparatus for spraying liquids and relates more particularly to spray guns and to so-called air brushes.

Spray guns and air brushes usually comprise a liquid reservoir closed by a cap or equivalent member constituting a spray head and carrying a liquid spray nozzle fed by a tube depending therefrom into the reservoir, an air jet positioned adjacent the spray jet and means for feeding pressure air from a suitable source to the air jet to cause a collimated flow or stream of air past the end of the spray jet whereby a negative pressure induced in the latter draws liquid from the reservoir and into the air stream wherein it is entrained as minute droplets. It is usual in such spray gun or air brush constructions to provide a valve in the air flow path to admit pressure air to or to prevent it from reaching the air jet, according to requirements and a trigger, push button or other member for actuating such valve is so positioned as to be operable by finger pressure.

Spray guns and air brushes as described in the preceding paragraph hereof will hereinafter be referred to as being spray guns and air brushes of the type defined.

One object of the present invention is to provide for shaping of the spray to suit the article being sprayed.

Another object is to vary the size of the flow path so that, where the source of compressed air is a pressurized container such as an aerosol container, compensation can be made for decreasing aerosol pressure over the life of the air source.

A further object is to smooth out transient variations in the air pressure to provide a more constant pressure in the air flow from the air jet.

According to one feature of the present invention, in a spray gun or an air brush of the type defined, the air valve comprises a valve seat and a closure member movable towards and away from said seat and adjustable means are provided for limiting opening movement of the valve closure member for controlling the cross-sectional area of the air flow path defined between that member and its seat.

Any convenient form of adjustable stop may be used, consistent only with providing for easy, preferably fingertip adjustability when the spray gun or air brush is in use. Thus, either a rotatable cam member or a threaded member may be arranged to limit movement of a lever arm by which the valve closure member is displaced from its seat. As an alternative to a stop, however, a threaded member may carry a conical valve closure member which is moved towards and away from its seat as the threaded member is rotated to axially displace it.

According to another feature of the invention, the spray gun or air brush is provided with an internal air chamber to which the pressure air is admitted and from which its outflow is controlled by the air valve. The air chamber acts to smooth out transient variations in the air pressure and to provide a more constant pressure in the air flow from the air jet.

The invention will be described further, by way of example, with reference to the accompanying drawings, in which:

FIG. 1 is a side elevation, partly in section, of a part of an air brush embodying the invention, FIG. 2 is a similar elevation of a detail of an air valve control lever, FIG. 3 is a plan view of the spray head, FIG. 4 is a front view of the spray head, and FIG. 5 is a detail showing a cam ring.

The air brush illustrated in the drawings is similar in its general arrangement to several conventional air brushes in that it comprises a reservoir 10 for liquid to be sprayed, the reservoir 10 being intended to be held in the hand and having a closure cap 12 provided adjacent its periphery with a spray nozzle 14 from which a tube 16 depends into the reservoir. The part of the cap 12 which carries the spray nozzle 14 may be regarded as the front and it will be seen that the nozzle is actually mounted on a platform 18 which is built up at the front so that in use, the reservoir is slightly tilted when held in the hand.

The rear of the cap 12 extends into an upstanding body portion 20 which terminates in a rearwardly directed tubular valve housing 22. An air jet 24 is mounted at the front of the body portion 20 with its forward end in close proximity to the free end of the spray nozzle 14 and the body portion is formed with an air flow passage 26 which leads to an air chamber 28 provided within the valve housing 22. The front end of the air chamber 28 presents a radial shoulder 30 constituting a valve seat which circumscribes a reduced diameter bore 32 wherein is guided an axially displaceable carrier 34. Within the chamber 28 the carrier 34 has a stepped end of enlarged diameter of which the larger diameter step 36 acts as a seat for one end of a valve closure spring 38 and the smaller diameter step is shaped to receive an O-ring 40 serving as a valve closure member co-operating with the valve seat 30. A tubular clip-on or screw-on handle 42 engages over a reduced diameter end portion of the valve housing 22, the handle 42 being formed with a generally axial passage 44 to receive an air supply hose 46. It is a feature of the invention that the hose 46 enters through the rear of the handle 42 and not, as is usual, in the vicinity of the reservoir 10. An axially bored plug 48 having a rearwardly directed spigot 50 acts as a seat for the other end of the spring 38 and also receives the incoming end of the air hose 46.

Extending axially forwardly from the carrier 34 is a pin or stem 52 which projects into a radial cavity 54 formed in the valve housing. A valve operating lever 56 pivoted at 58 to the valve housing has an arm 60 positioned within the cavity 54, the arrangement being such that, when the reservoir 10 is held in the hand, the lever 56 can be depressed by the finger so that the resulting pivotal movement of the arm 60 acts through the stem 52 to unseat the valve closure member 40.

In accordance with the invention, a stop means to enable this pivotal movement of the arm 60 to be arrested for the purpose of limiting opening movement of the valve closure member 40 comprises a rotatably mounted cam ring 64 which is peripherally knurled to render it readily rotatable by finger pressure and which on its rear face has a raised cam surface 66 provided with a generally circumferentially directed land 68. The land 68 provides a stop for the forward end of the valve operating lever 56 when the latter is depressed to displace the carrier member 34 against the pressure of the valve spring 38. When finger pressure is released, the action of the valve spring 38, of course, acts to lift the forward end of lever 56 from that stop. By altering the rotational position of the cam ring 64 it will be appreciated that pivotal movement of the operating lever 56 is altered to change the extent to which the valve member 40 may be unseated.

If desired, the air jet 24 may be axially displaceable towards and away from the spray jet 14 and this axial movement may be independent of or it may be associated with rotational movement of the cam ring 64. It will be appreciated that axial adjustment of the air jet 24 relative to the spray jet 14 makes possible a wider range of adjustment of spray pattern than does adjustment of the closure member 40 alone.

Again, the spray jet 14 may be arranged for axial displacement (for example by virtue of its threaded mounting in the cap 12) thus also increasing the range of adjustment possible in the spray pattern.

I claim:

1. A spray gun comprising a reservoir means for containing liquid, a spray head, a spray jet carried by the spray head, a tube depending from the spray jet into the reservoir means for feeding the spray jet, an air jet positioned adjacent the spray jet, means for conducting pressure air from a source to the air jet to cause a stream of air to flow past the spray jet whereby a negative pressure induced in the latter draws liquid from the reservoir means and into the air stream, a valve housing through which passes the means for conducting pressure air, a manually operable air valve arranged in the housing and comprising a valve seat and a valve closure member movable towards and away from the seat, lever means mounted externally of the housing and arranged to cooperate with the valve closure member to move said member away from the valve seat, and a manually adjustable stop comprising a rotatable cam ring arranged to limit movement of said lever means so as to limit displacement of said valve away from said seat.

2. A spray gun according to claim 1 having a valve housing which contains an air chamber, the means for conducting pressure air including said air chamber and the air valve being arranged within the valve housing to control the outflow of air from the chamber.

3. A spray gun according to claim 2 in which the valve housing is tubular and the valve seat comprises a radial shoulder presented by the downstream end of the air chamber, said shoulder circumscribing a reduced diameter bore wherein is guided an axially displaceable carrier carrying the closure member.

4. A spray gun according to claim 3 including manually operable lever means mounted externally of the tubular valve housing and a pin extending from the carrier, which pin co-operates with the lever means to displace the closure member from its seat, the closure member comprising a sealing ring mounted on a stepped end, of enlarged diameter, of the carrier.

5. A spray gun according to claim 4 further comprising a tubular handle which is attached at one end to the valve housing and through which said means for conducting pressure air passes into the air chamber.

6. A spray gun according to claim 1 in which the air jet is displaceable towards and away from the spray jet.

7. A spray gun according to claim 1 in which the spray jet is displaceable towards and away from the air jet.

* * * * *